United States Patent [19]

Voorheis

[11] Patent Number: 4,488,869

[45] Date of Patent: Dec. 18, 1984

[54] HIGH EFFICIENCY, LOW NOX EMITTING, STAGED COMBUSTION BURNER

[75] Inventor: Temple S. Voorheis, Atherton, Calif.

[73] Assignee: Coen Company, Inc., Burlingame, Calif.

[21] Appl. No.: 395,412

[22] Filed: Jul. 6, 1982

[51] Int. Cl.[3] ..... F23D 15/02

[52] U.S. Cl. ..... 431/352; 431/351; 431/182; 239/405; 239/406

[58] Field of Search ..... 431/351, 352, 182–185; 239/405, 406

[56] References Cited

U.S. PATENT DOCUMENTS

| | | | |
|---|---|---|---|
| 2,831,535 | 4/1958 | Lange | 431/188 |
| 3,545,202 | 12/1970 | Batt et al. | 431/352 |
| 3,923,251 | 12/1975 | Flournoy | 431/351 |
| 4,054,028 | 10/1977 | Kawaguchi | 431/352 |
| 4,303,386 | 12/1981 | Voorheis et al. | 431/183 |
| 4,351,632 | 9/1982 | Nagai | 431/351 |

FOREIGN PATENT DOCUMENTS

| | | | |
|---|---|---|---|
| 162809 | 4/1954 | Australia | 431/351 |
| 616300 | 1/1949 | United Kingdom | 431/352 |

*Primary Examiner*—Carroll B. Dority, Jr.
*Attorney, Agent, or Firm*—Townsend and Townsend

[57] ABSTRACT

A staged, high efficiency burner for gaseous, liquid or pulverized solid fuels (including fuels having a high nitrogen content) in which NOX emissions are minimized. The burner includes a burner basket having a base including a throat and a concentric, tubular, frustroconically shaped wall that defines a primary combustion space. The fuel and primary air of about 75% of stoichiometric air are introduced into the basket which has a length so that the fuel has a residence time therein of between about 0.1 to 0.5 second. Secondary air is introduced into the flame downstream of the basket in the form of a multiplicity of individual air streams which are oriented to penetrate the flame and spin it about its axis so as to maintain a substantially cylindrical flame periphery. Part of the secondary air can be introduced through the tubular wall of the basket to shorten the flame length while maintaining the low level NOX emissions and the high efficiency of the burner by directing that part of the secondary air into the primary space so that the formation of pockets which have a high or excess air content cannot form. The flame basket can be disposed fully within the combustion chamber of the furnace or, to prevent it from penetrating excessively into the chamber, part of the basket can be disposed outside the chamber.

39 Claims, 7 Drawing Figures

HIGH EFFICIENCY, LOW NOX EMITTING, STAGED COMBUSTION BURNER

BACKGROUND OF THE INVENTION

The increasing scarcity and the resulting increasing cost of fuel make it mandatory that today's burners operate at top efficiency. Further, environmental concerns require that the discharge of pollutants, and particularly of nitrogen oxides (hereinafter NOX), be minimized.

Amongst the measures to attain high efficiency, operating of the burner with the least amount of air is of utmost importance. This means that a burner should be operated with the least amount of excess air, that is the theoretically required amount of air to fully combust the fuel (hereinafter in the specification and the claims sometimes referred to as "stoichiometric air") plus the amount of excess or additional air that must be supplied to assure that all fuel will be combusted or oxidized. With today's best burner designs that typically means an amount of air only about 5% above the stoichiometric air.

To minimize the NOX emissions, more intricate measures must be taken. NOX is generated at high temperatures, that is temperatures in excess of about 3000° F. Because of the greater affinity of oxygen (in the combustion air) to combustible materials in the fuel as compared to nitrogen, practically no NOX is generated while there is an oxygen deficiency, that is when the fuel is combusted in the presence of less than the theoretically required amount of air to fully combust the fuel (hereinafter in the specification and the claims also sometimes referred to as "off-stoichiometric air"). Further, practically no NOX forms at temperatures below about 3000° F. Thus, as long as the fuel is combusted with off-stoichiometric air or the temperature is kept below 3000° F. there are substantially no NOX emissions.

In large industrial furnaces such as boilers for electric generating plants, which employ multiple burners, these objectives are attained by controlling the air supply so that there is a "staged combustion", that is a combustion which, during a first stage, takes place in an oxygen deficient environment and, in a second stage, takes place at a relatively low temperature. Systems to accomplish this typically employ auxiliary air inlets spaced from and in relation to the burners so that the secondary combustion air, that is the air to bring about a complete combustion of the fuel, is introduced downstream of the burners. This approach has proved most successful.

However, small furnaces such as package boilers have only a single burner and a pre-assembled combustion chamber which does not permit an arrangement as disclosed in the preceding paragraph because of the size, shape, orientation and construction of the combustion chamber which typically is horizontal and has a tubular shape through which the flame extends. There is no space to arrange separate air inlets above the burner or in the side walls of the combustion chamber.

Consequently, prior art package boilers and furnaces employing only one burner either had to be operated at low temperatures to avoid the generation of NOX, which meant they had to be operated with large amounts of excess air which reduced their efficiency, or if high efficiency was most important, high levels of NOX emissions had to be accepted. Neither alternative is acceptable under today's economic conditions and concerns for the protection of the environment.

Further, when operating such a burner at the required relatively low temperature to prevent NOX emissions the boiler had to be de-rated, that is its steam producing capacity had to be lowered to prevent the formation of excessively long flames which would extend into the boiler convection section.

SUMMARY OF THE INVENTION

The present invention provides a self-contained burner for the staged combustion of gaseous, liquid or pulverized solid fuels, including fuels having a relatively high, chemically bound nitrogen content such as, for example, California (Kern County) heavy grade crude oil, in which the emission of objectionable NOX is substantially eliminated. Yet, this burner can be operated with as little as 5% excess air, the amount of excess presently considered necessary to effect a complete combustion of all fuel. Thus, the burner can be used for packaged boilers without sacrificing efficiency, without generating objectionable levels of NOX and without the need for de-rating the boiler.

Generally speaking, the present invention accomplishes this by providing a flame basket which forms part of the burner and which defines a primary combustion space in which the fuel is combusted with off-stoichiometric air, usually not less than about 65% and preferably about 75% of stoichiometric air. The primary combustion air rotates about the flame axis at a sufficient rate to effect a rapid and uniform mixing of the air and the fuel. Typically, this requires a (primary air) swirl No. $\geqq 1$. The flame basket has a sufficient length so that the retention time of the flame in the basket is in the range of between about 0.1 to about 0.5 seconds, the shorter time periods of the range being applicable to nitrogen-lean fuels and the longer time periods to nitrogen-rich fuels because extended flame retention times in the first stage facilitate the reduction of NOX emissions.

Further, the flame basket has cut-outs, preferably in the form of undulations in its free-end (which communicates with the main combustion chamber of the furnace) to achieve a direct (substantially perpendicular to the flame axis) radiation heat transfer to heat exchange surfaces, e.g. the boiler tubes surrounding the flame basket. The resulting drop in the temperature of the flame as it exits the primary combustion space of the basket (first stage combustion) and enters the main combustion chamber of the furnace (second or burnout stage) helps to maintain a second stage flame temperature below about 3000° F., the temperature level below which NOX is not generated in objectionable amounts.

The balance of the combustion air, that is the secondary combustion air, is then injected into the flame in the combustion chamber of the furnace. In accordance with the invention, this is done by forming a multiplicity of secondary combustion streams which are equally distributed about the flame and are directed into the flame at axially spaced points. This assures good and uniform mixing of the secondary air with the flame and prevents the formation of a secondary air sheath in the flame which can adversely affect the combustion process.

To assure a uniform dispersal of the secondary air into the flame and a complete combustion of all fuel, the secondary air streams converge in a downstream direction towards the flame axis. Since this arrangement has a tendency of compressing the flame periphery, the secondary airstreams further lie in planes which are non-parallel and angularly inclined with respect to the flame axis to impart a rotary motion to or to spin the flame at a rate selected to offset the peripheral flame compression caused by the converging secondary airstreams. As a result, the flame periphery throughout the combustion chamber remains substantially cylindrical.

By operating the burner in the manner described in the preceding paragraphs, the off-stoichiometric first stage combustion combined with the intimate and uniform mixing of primary air with fuel prevents the formation of high oxygen pockets in the flame so that substantially no NOX is generated there. The cooling of the flame before it enters the second stage combustion prevents the flame from exceeding the 3000° F. temperature level which is critical to prevent NOX generation where excess oxygen is present. The uniform mixing of the secondary combustion air with the flame in the second stage so that the flame shape is substantially cylindrical makes it possible to complete the combustion process with little, e.g. 5% excess air, while maintaining a relatively short flame length even though it is of a relatively low temperature. Previously encountered problems caused by excessive flame lengths, including especially the need for de-rating the boiler, are thereby prevented.

Nevertheless, large burners size, say burners having a throat diameter of between 18 or 20 inches up to as much as 30 inches or more, however, can still have excessively long flames and/or of incomplete combustion because it becomes increasingly difficult to uniformly distribute the secondary air throughout the relatively large flame. To alleviate this problem the present invention contemplates to introduce a portion of the secondary air into the primary combustion space defined by the flame basket downstream of the throat but upstream of the basket outlet.

To this end, secondary air orifices are placed in the basket wall and oriented so that resulting secondary airstreams are tangent to an imaginary cylinder (which is concentric with the flame axis) at axially spaced points thereon. The secondary air streams in the primary combustion space are low volumetric flows best attained by providing a relatively large number of correspondingly small diameter orifices to assure a quick and uniform dispersal of the secondary air into the flame without the formation of excess air pockets which could lead to the generation of NOX.

Since the small volumetric secondary air flows cannot penetrate deeply into the flame, the larger burners can further be provided with additional secondary air orifices which are located upstream of the first mentioned orifices and which direct secondary air towards the center of the flame. Typically, the number of these additional orifices will be smaller than the number of the first mentioned secondary air orifices to facilitate the desired deeper penetration of the air towards the vicinity of the center of the flame.

The arrangement in which secondary combustion air is introduced into the flame basket has the advantage that it reduces the overall length of the flame without causing a heat up of the flame in the combustion chamber above the critical 3000° F. level. Yet, the burner can be efficiently operated with as little as 5% excess air.

Regardless of the specific arrangement of the secondary air orifices, it is preferred that the ratio of the volume of secondary air introduced into the primary combustion space and into the (second stage) combustion chamber does not exceed 1:2. The distribution of the secondary air between the first and second set of orifices is preferably roughly equal.

In a presently preferred embodiment in which the flame is operated with 5% excess air, the primary combustion air comprises about 75% of stoichiometric air and the secondary combustion air comprises the remainder of the required combustion air, e.g. 30% of stoichiometric air. If secondary air is also introduced into the flame basket 10% of stoichiometric air is introduced there while 20% of stoichiometric air is introduced into the second stage or burnout zone.

An actual burner capable of operating as above-described and constructed in accordance with the present invention comprises a burner basket constructed of refractory material. The basket has a base that defines a burner throat through which the fuel and the primary combustion air enter. A burner wall extends from the base towards the outlet end and includes the undulations which form the heat radiation cut-outs. Secondary combustion air conduits are usually embedded in the wall and terminate at the outlet end of the wall at axially spaced locations determined by the wall undulations. The basket is adapted to be demountably attached to a furnace wall and is connected with a primary air wind box and a register which rotates the primary air entering through the throat sufficiently so that centrifugal forces expand the flame within the basket and assure that the flame at all times contacts the basket wall. To facilitate this, the throat is flared outwardly in a downstream direction and is given a convex shoulder of a radius of up to 18 inches. In addition, a secondary air plenum for the secondary air conduits and, optionally, means for regulating the relative air flow through the conduits are provided.

The fuel is introduced into the basket centrally with respect to the throat through suitable gaseous, liquid or pulverized solid fuel nozzles. The construction and operation of such nozzles is well-known and is not further described herein.

To assure the required flame retention time in the basket, the basket has a preferred length of between about 24 inches for low nitrogen fuels to as much as 96 inches for high nitrogen fuels although the basket can be lengthened or shortened as required for a particular installation. For relatively long baskets, a portion of the basket can be disposed outside the furnace wall to prevent the basket from protruding too far into the main combustion chamber of the furnace.

A burner constructed and operated as described above has an efficiency which compares favorably with the efficiency attained in furnaces employing multiple burners, auxiliary air inlets and the like. Yet, it is self-contained and can be installed as a single burner in relatively small boilers, industrial furnaces and the like.

In addition to its efficiency, the burner of the present invention reduces the NOX generation when natural gas is burned from about 175–225 ppm to about 50–60 ppm. For low nitrogen containing fuel oil NOX production is reduced from about 300 ppm to around 90 ppm. Similar NOX reductions are attained when burning high nitrogen content fuel oil or coal (pulverized).

Thus, the burner of the present invention is an environmentally sound, energy-efficient and, therefore, economic burner which is expected to find widespread acceptance wherever single burner furnaces are operated.

DESCRIPTION OF THE PREFERRED EMBODIMENTS

Figure 1:
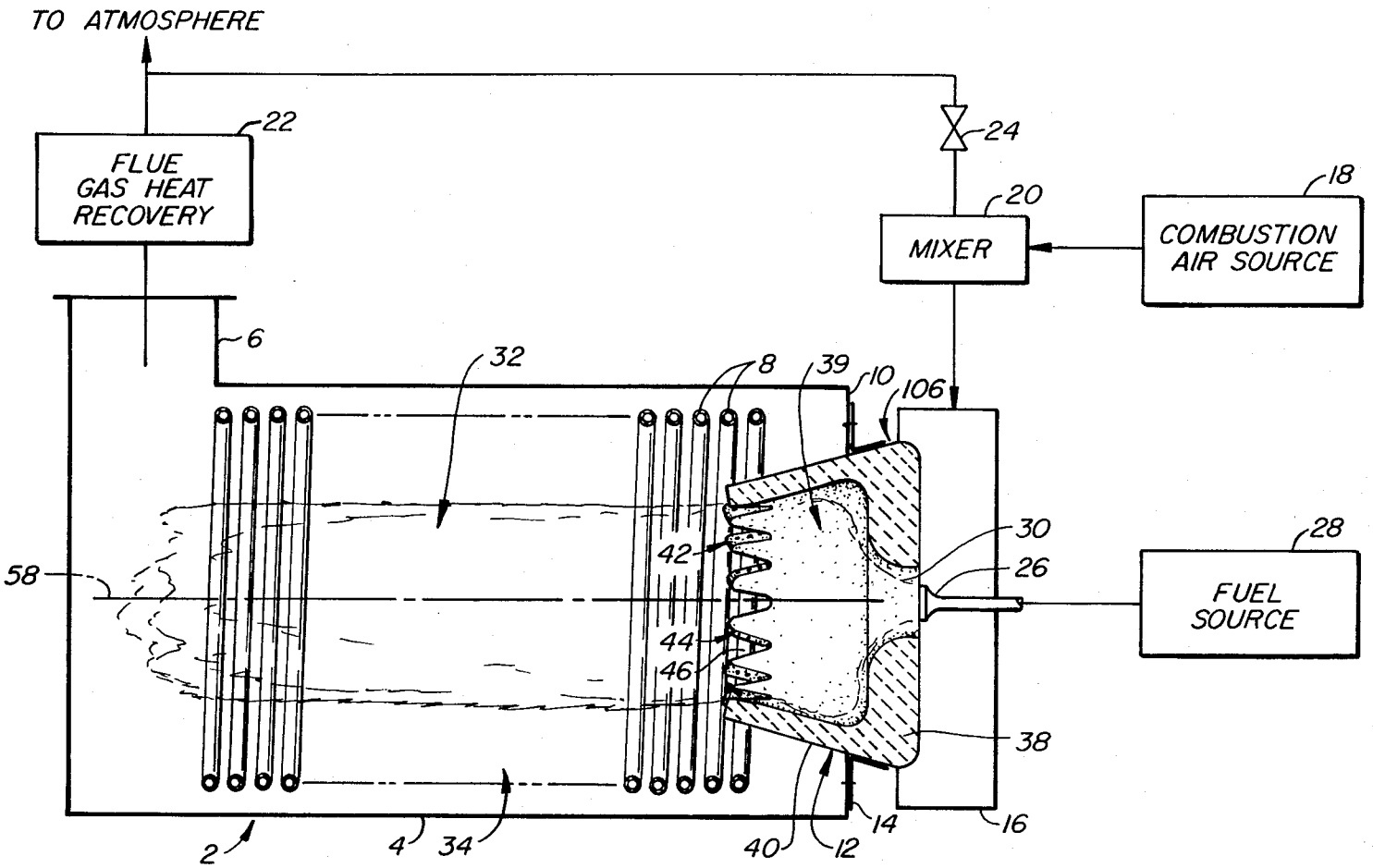
FIG. 1 is a schematic, side elevational view, in section, of a package boiler fitted with a burner constructed in accordance with the present invention.

Referring to FIG. 1, a typical "package boiler" 2 has a main, generally circular body 4, the downstream end of which terminates in a flue 6. Disposed within the boiler are a multiplicity of heat exchange tubes 8. The upstream end of the boiler is defined by an end wall 10. A burner 12 constructed in accordance with the present invention is demountably secured to the end wall with brackets 14 or the like. A schematically illustrated wind box 16 is fluidly connected to a source of combustion air 18. For purposes more fully described hereinafter, a mixer 20 may be provided for adding to the combustion air flue gas which has been cooled in a flue gas cooler 22. A valve 24 controls the flow of cooled flue gas to the mixer.

A fuel nozzle 26 is connected to a suitable fuel source 28 and disperses fuel via a burner throat 30 into the burner. There the dispersed fuel is mixed with the combustion air and ignited to form an elongate flame 32 within a combustion chamber 34 of the boiler. Any suitable fuel such as natural gas, fuel oil or pulverized coal can be used.

Figure 2:
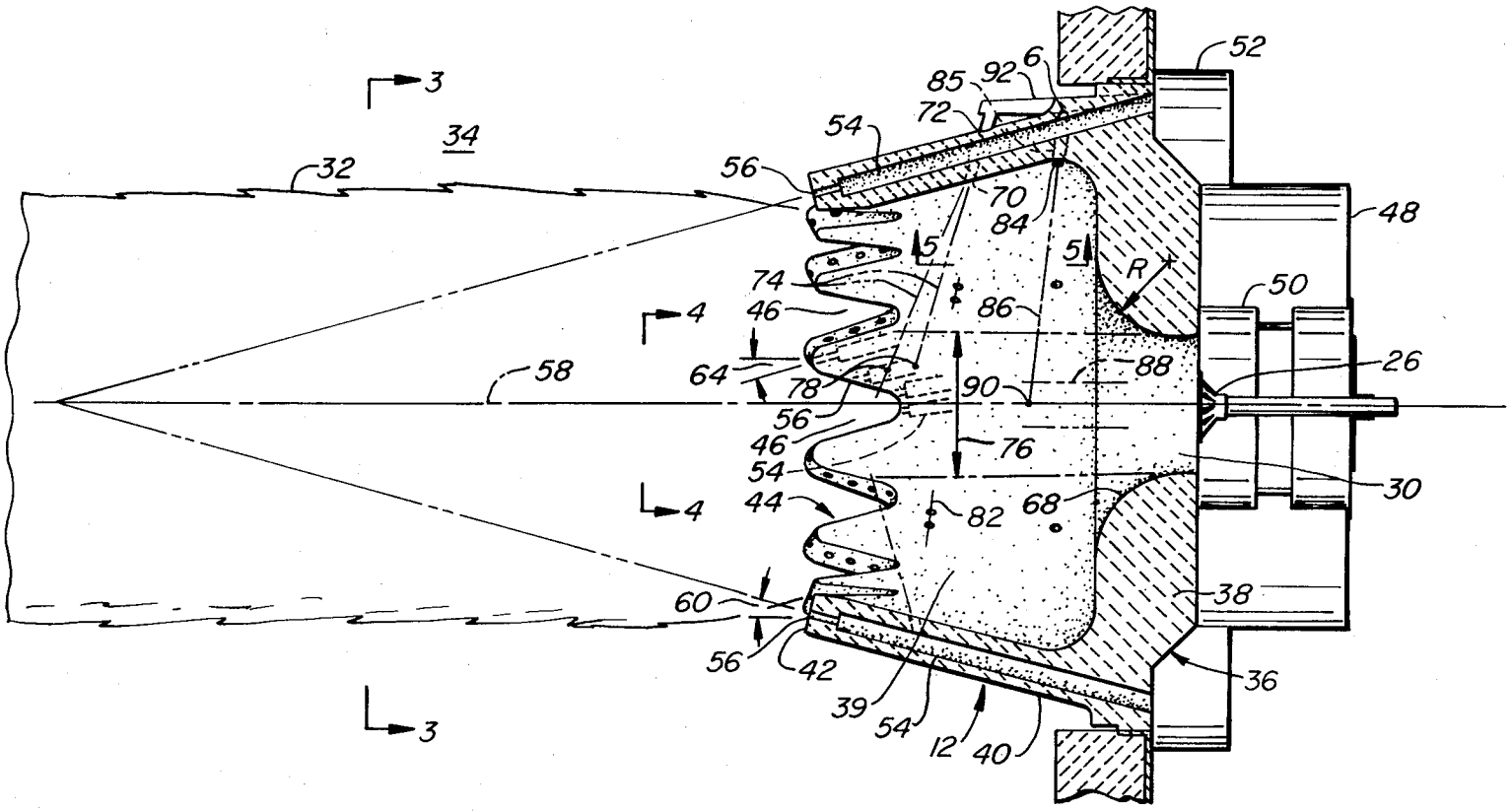
FIG. 2 is an enlarged, cross-sectional side elevational view of the burner of the present invention.

Referring now to FIG. 2, burner 12 of the present invention comprises a flame basket 36 constructed of refractory material. It has a relatively thick base 38 which defines the burner throat 30 and a tubular wall 40 which projects away from the base in a downstream direction into combustion chamber 34 of boiler 2. The base and wall define a primary combustion space or zone 39. The tubular wall terminates in a scalloped outlet end 42 formed by undulations 44 which define a multiplicity, say 12 generally triangularly shaped cutouts 46 which extend from the outlet end 42 in an upstream direction.

On the outside of the flame basket, that is the side of base 38 facing the exterior of the boiler is mounted a register wind box 48 which fluidly communicates with a source of primary combustion air (not separately shown in FIG. 2). A register 50 of a conventional construction such as, for example, the one sold by Coen Company of Burlingame, Calif., under the designation SAZ-15 is disposed within the wind box. The register is constructed (or the Coen Co. register is modified to) spin or swirl primary air entering the burner throat 30 at a relatively high rate about burner axis 58 to achieve a swirl No. $\geqq 1$ so that the air, upon entering primary combustion space 29, hugs or contacts flame basket wall 40. To facilitate this, the section 68 of the burner throat contiguous with the primary combustion space is flared outwardly (in a downstream direction) and is given a relatively large radius "R" of between about 12" to 18" and typically about 15".

Also disposed on the exterior side of flame basket base 38 is a secondary combustion air plenum 52 which is ring-shaped and generally surrounds the wind box 48. It is connected to a source of secondary combustion air (not separately show). A multiplicity of equally spaced, secondary combustion air conduits 54 are disposed within basket wall 40 and extend from the secondary air plenum 52 in a downstream direction to outlet end 42 where each conduit forms a discharge opening 56. Preferably the conduits are formed by metal, e.g. steel tubes embedded in the refractory material of the basket wall, although, if desired, the conduits may be directly formed in the refractory material.

Figure 3:
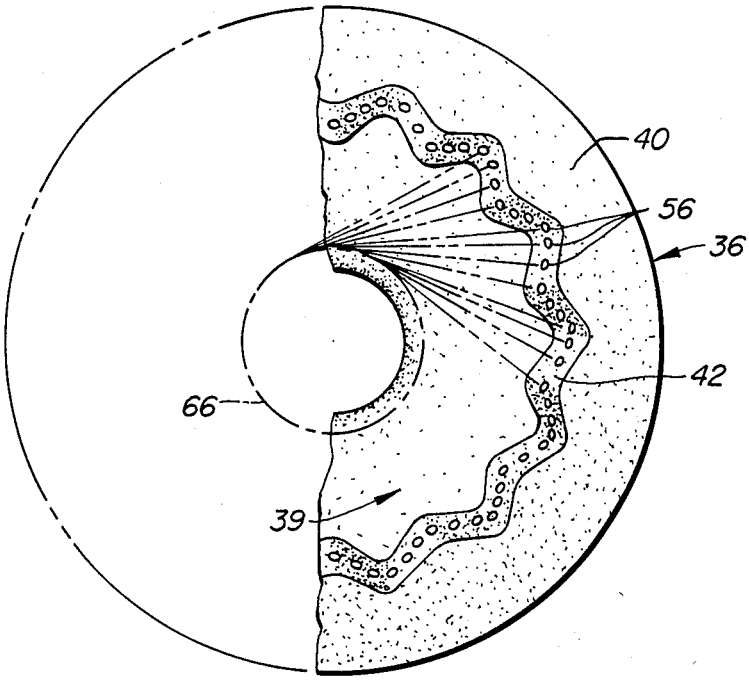
FIG. 3 is a schematic, front elevational view of the burner, is taken on line 3—3 of FIG. 2, and illustrates the geometry of the secondary air injection.

The conduits (as well as the tubular wall 40 in which they are embedded) are angularly inclined with respect to the burner axis 58 so that their projections converge in a downstream direction on the burner axis at an angle 60 which is in the range of between about 7° to 15°. Additionally, the conduits lie in planes 62 which are non-parallel to the burner axis, that is which form an angle 64 with the axis of between about 10° to 20°. When secondary air is discharged into combustion chamber 34 from secondary air conduits 56, the resulting secondary air streams are tangent to an imaginary cylinder 66 (shown in FIG. 3) which is concentric with the burner axis. Typically, it has a diameter no larger than the diameter of burner throat 30.

In use, low pressure air, typically having no more than a 2½" to 4" water column pressure, is introduced into the wind box 48 and the register 50 swirls the air at a sufficient rate so that the air in the primary combustion space 39 at all times contacts the flame basket wall 40. The primary combustion air flow is limited to an off-stoichiometric amount, typically at least about 65% and preferably about 75% of stoichiometric air. Fuel dispersed in the primary combustion space 39 by nozzle 26 is intimately mixed with the swirling primary air and ignited to form flame 32 which propagates in a downstream direction toward and past basket outlet end 42 into the combustion chamber 34. The intimate and rapid mixing of the fuel with the swirling air assure a uniform oxygen deficiency throughout the entire primary combustion space so that the formation of "excess air pockets" within that space, and the generation of NOX resulting therefrom, is prevented.

The construction, including the size of the flame basket, is of importance to minimize NOX. As already mentioned above, maintaining an oxygen deficiency in the primary combustion space is of utmost importance. However, the generation of NOX is also influenced by the residence time of the flame in the primary combustion space. If the residence time is insufficient, then the original fuel nitrogen (nitrogen present in the fuel as constrasted with the nitrogen present in the combustion air) will exist in the gaseous state as some nitrogen compound (hereinafter "XN") which can be converted into NO in the second stage or zone. Thus, to minimize or eliminate NX production in the primary combustion zone the flame basket (which can become NOX in the secured stage) a residence time of at least about 0.1 second is required for burning fuels having a very low nitrogen content, such as natural gas. For relatively high nitrogen content fuel oil, such as Kern County crude oil which has a nitrogen content of about 0.8%, a residence time of about 0.3 to 0.4 seconds is desirable while for even higher nitrogen content fuels, such as certain coals, residence times of up to 0.45–0.5 seconds are indicated. This translates into a flame basket length (from the basket base 38 to the wall outlet end 42) which has an outside range of about 12 inches to 96 inches. For most practical applications, and the presently preferred basket length range is between 24 to 96 inches.

The relatively long flame retention times in the basket has the additional advantage that the burn rate is relatively low and, consequently, the maximum temperature is maintained lower. This is further aided by the off-stoichiometric firing of the fuel, that is the more fuel-rich the flame is the lower will be its maximum temperature.

As the flame propagates through the primary combustion space it first reaches cut-outs 46 where it radiates heat in the most efficient manner, that is perpendicular to its axis, to the heat exchange tubes 8 surrounding the flame basket. Consequently, the flame temperature drops before the flame reaches its burn-out zone in the combustion chamber 34 of boiler 2. This aids in maintaining the maximum temperature in the burn-out zone below the critical 3000° F. level.

As the flame propagates further into the combustion chamber, it is mixed with secondary combustion air that issues from conduit ends 56 to effect the burn-out or complete combustion of all fuel. The converging secondary combustion air fuel penetrates into the flame towards the center thereof to assure an equal distribution of the secondary air throughout the flame which faciliates the complete combustion of all fuel. Since the converging airstreams have a tendency to compress the flame towards the burner axis 58, the secondary air conduits 54 are arranged so that the air streams therefrom are tangent to an imaginary circle and thus swirl or rotate the flame. The rate of rotation is selected to generate a centrifugal force in the flame which offsets the tendency of the convering airstreams to compress the flame so that the flame periphery remains relatively constant and cylindrical over its length. To achieve the necessary penetration of the flame, and an intimate and turbulent mixing of the secondary air with the flame and the unburned fuel, the secondary air is normally at a relatively higher pressure than the primary air of between about 6 to 8 inches water column.

An efficient combustion process also requires that the secondary air is quickly and evenly introduced into the flame. Aside from the above discussed orientation of the secondary air conduits 54 and the relatively higher secondary air pressure, this is achieved by providing a relatively large number of relatively small diameter secondary air conduits. In a presently preferred embodiment, the conduits are arranged so that their discharge ends 56 are equally spaced apart no more than between about 1 to 2 inches.

To prevent the secondary air from developing an air curtain or sheath in the flame having areas or pockets of high excess oxygen, the secondary air discharge ends 56 terminate at axially spaced points as determined by the basket undulations 44. In this manner, parts of the flame periphery come in contact with secondary air earlier than other parts. Furthermore, due to a relatively higher pressure in the primary combustion space 39 the flame, as it passes wall cut-outs 46, begins to expand outwardly into the cut-outs. Thus, parts of the flame become mixed with the secondary air at the upstream ends of cutout 46 while other parts of the flame become mixed with secondary air further downstream, e.g. at the downstream tip of the undulations. This also increases the flame turbulence and therefore the intimacy with which the secondary air is mixed with the flame, all of which facilitates an even and complete combustion of all fuel with a minimum, e.g. 5% excess air.

Yet, inspite of the low excess air operation of the burner of the present invention, the two-stage combustion achieved with the flame basket, coupled with the extended flame retention times in the basket, the radiation cooling of the flame via the cut-outs, and the uniform mixing of the flame with secondary air, make it possible to maintain flame temperatures below the 3000° F. level, particularly in the burn-out zone where, in contrast to the primary combustion space, there is an oxygen surplus rather than deficiency.

For larger burners, say burners having throat diameters in excess of 20 inches, the above-described staged fuel combustion leads to relatively long flames which can only be reduced by increasing the excess air above what is presently considered to be about the absolute minimum of 5%. This, in turn, reduces the efficiency of the burner and may even increase NOX levels. To avoid this, the present invention contemplates to add up to one-third of the secondary air, or about 10% of stoichiometric air, to the flame in the primary combustion space 39 after the fuel has been ignited.

Figure 4:
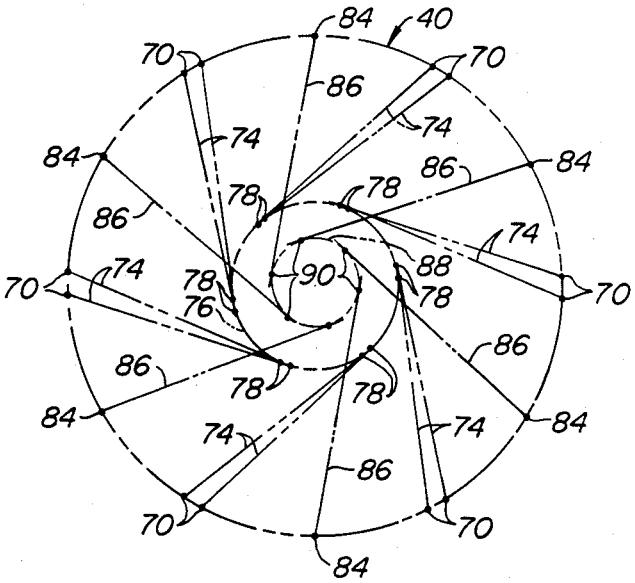
FIG. 4 is a view similar to FIG. 3, is taken on line 4—4 of FIG. 2 and illustrates the geometry of another aspect of the secondary combustion air injection.
Figure 5:
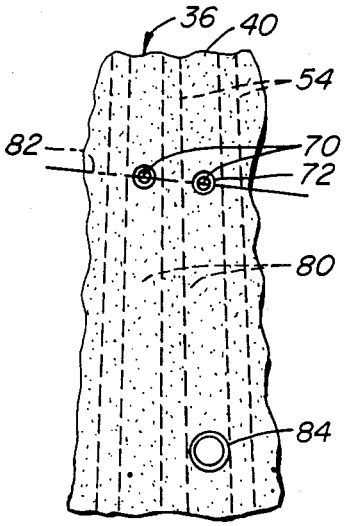
FIG. 5 is a fragmentary, side elevational view of a portion of the burner and is taken on line 5—5 of the FIG. 2.

Referring now to FIGS. 2, 4 and 5, for intermediate size burners, such secondary air is introduced into the primary combustion space 39 through a plurality of orifices 70 in wall 40 of the flame basket. The orifices and the associated passageways 72 orient the resulting secondary air flows (schematically illustrated in FIGS. 2 and 4 by phantom lines 74) so that each stream is tangent to an imaginary cylinder 76 which is concentric with burner axis 58 and may have, for example, about the same diameter as throat 30.

To forestall the formation of NOX, it is important to quickly and uniformly disperse the secondary combustion air introduced via orifices 70 throughout the flame to prevent the formation of pockets in the primary combustion space where the oxygen content approaches or exceeds stoichiometric air. To this end the orifices (and the associated passageways 72) direct the secondary air flows 74 into the primary combustion zone so that the points of tangency 78 between the air flows and the imaginary cylinder 76 are spaced apart in an axial direction. Further, the orifices have relatively small diameters so that the inertia of the secondary air flows is relatively low which results in a rapid diffusion of the secondary air throughout the flame. This also facilitates the construction of the passageways since they must extend through the relatively narrow basket wall spaces 80 between adjoining secondary air conduits 54. Thus, in a preferred embodiment of the invention where the 10% secondary air introduced into the flame basket is introduced at six equally spaced locations, for example, each location is provided with a pair of orifices the associated passageways of which straddle a secondary air conduit 54 located between them as is best shown in FIG. 5.

To effect the desired axial spacing of the tangent points 78 on the imaginary cylinder 76, each orifice (of the six orifice pairs, for example) lies on an inclined plane 82 as is shown in both FIGS. 2 and 5 to effect the desired axial spacing of the tangent points shown in FIG. 2. Alternatively, all orifices can be located in a common plane that is perpendicular to the burner axis. In such an event, the passageways have varying angular inclinations to obtain the desired axial spacing of all tangent points 78.

In use the burner including secondary air orifices in the flame basket wall is operated as described above except that the secondary air introduced into the flame in the burn-out zone is reduced, say from 30% to 20% of stoichiometric air. The balance, e.g. 10% of stoichiometric air is introduced into the primary combustion space via orifices 70. This arrangement has the advantage that more fuel is combusted in the primary combustion space so that the burn-out zone can be shortened which leads to a corresponding shortening of the flame length. By introducing the secondary air downstream of the point where the primary air enters (through burner throat 30) the potential of excess air pockets in the primary combustion zone, and particularly in the vicinity of the burner base is reduced or eliminated. Further, by introducing the secondary combustion air into the primary combustion zone by way of a multitude of relatively small secondary air flows spaced in an axial direction and maintained tangent to the imaginary cylinder 76, the secondary air is rapidly dispersed. Excess air containing pockets, which could form in the flame if high volume secondary airstreams were introduced, are avoided. Thus, the danger of NOX formation due to the localized presence of excess oxygen is effectively prevented.

For even larger burners, say a burner having a 30-inch diameter throat, it is of importance to distribute the secondary air introduced into the primary combustion space 39 into the vicinity of the core or center of the flame (which surrounds burner axis 58). The relatively small, low inertia secondary airstreams discharged from orifices 70 are typically unable to reach the flame center so that a non-uniform oxygen distribution throughout the primary combustion air space may result. In such instances, the present invention provides an additional set of relatively larger diameter orifices 84 which are located upstream of orifices 70 and which may be at the same circumferential location as the first mentioned orifices. However, to provide the resulting secondary air flows 86 with the desired inertia to penetrate to the flame core there is only one orifice at each location. Since the secondary air conduit 54 in burner wall 40 diverge in an upstream direction the wall spaces 80 between adjoining conduits provide sufficient room therefor in the vicinity of basket base 38. The larger orifices 84 are constructed so that airflows therefrom are tangent to a relatively small diameter imaginary cylinder 88 and they are oriented, in the manner discussed above in connection with the description of orifices 70, so that the points of tangency 90 are spaced apart in an axial direction.

Secondary combustion air for orifices 70, 84, is provided from secondary air plenum 52 via suitably arranged supply tubes 92. The volumetric flow of air through the orifices is controlled by appropriately sizing the associated passageways 72 and 85. Alternatively, where it is desirable to vary the pressure of the secondary airstreams 74 or 86 an appropriate pressure regulator, control valves or an entirely separate air plenum (not separately shown in the drawings) may be provided. Typically, however, this will neither be necessary nor desirable.

Figure 6:
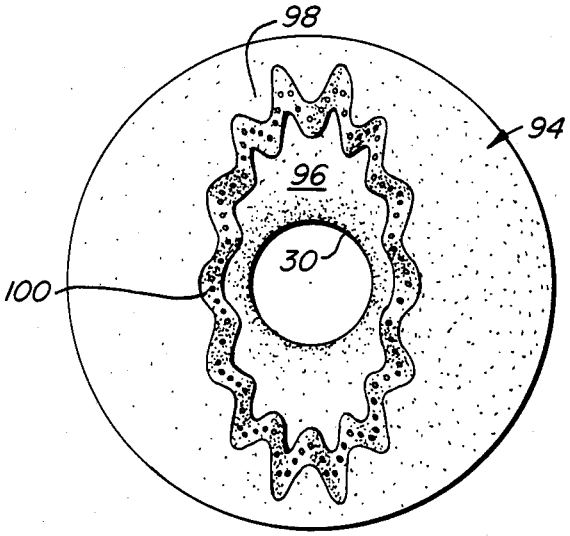
FIG. 6 is a front elevational view similar to FIG. 3 but illustrates a flame basket having a generally ovally shaped outlet end.
Figure 7:
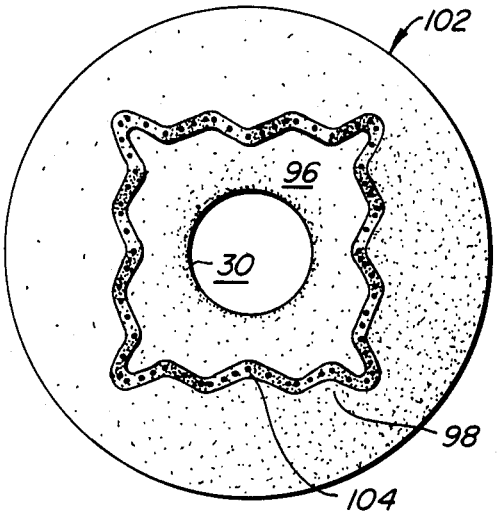
FIG. 7 is a view similar to FIG. 3 but illustrates a flame basket having a generally rectangular outlet end.

For optimum efficiency, it is desirable that the periphery of the flame in the combustion chamber 34 is equally spaced from the surrounding heat exchange tubes 8. Referring now to FIGS. 6 and 7, in instances in which the boiler body has an oval cross-section, and to maintain the desired constant spacing between the flame periphery and the heat exchange tubes, a flame basket 94 otherwise constructed in the same manner as basket 36 described above has a cylindrical base 96 and a tubular wall 98 which converges in a downstream direction. It has an outlet end 100 of an oval configuration complementary to that of the boiler body (not shown). To accommodate this construction the tubular wall 98 has a cross-section which changes from circular proximate the base to the oval configuration at the outlet end.

The flame basket 102 illustrated in FIG. 7 is constructed similarly to flame basket 94 shown in FIG. 6. It differs therefrom only in that its outlet end 104 has a rectangular (which includes square) configuration complementary to a rectangular (or a square) configuration of a boiler body (not shown) so that the periphery of the resulting flame is generally rectangular. The remainder of the construction of burner basket 102 is the same as that of flame basket 94 shown in FIG. 6 and, therefore, has the same reference numerals. The operation of flame basket 94 and 102 is as described for flame basket 36 shown in FIGS. 2–5.

Referring again to FIGS. 1 and 2, when the burner 12 of the present invention is operated with fuel having a high nitrogen content, such as certain pulverized coals, the flame retention times to prevent the formation of NOX may require a basket length which can interfere with the operation of the boiler. In such instances, brackets 14 which mount the burner to boiler end wall 10 can be moved on the burner in a downstream direction so that a relatively long segment 106 of the flame basket is disposed outside the boilers.

Alternatively, or in addition thereto, the rate of combustion (and therewith the temperature of the flame) can be lowered by circulating cooled flue gas from flue gas cooler 22 via valve 24 into the combustion air, normally the secondary combustion air introduced into the flame downstream of the basket. The presence of flue gas in the combustion air lowers the overall oxygen content thereof and thus slows down the combustion process. In addition, there will be an overall increase in the amount of inert substances in the combustion gas which, in turn, lowers the overall flame temperature. This further aids in reducing or eliminating the formation of NOX which might be of utmost importance for users of high nitrogen containing fuel. A drawback of this alternative, however, is that there is some loss of efficiency. Consequently, this manner of operating the burner of the present invention should normally only be employed where the fuel contains relatively high levels of bound nitrogen.

I claim:

1. A burner basket for use with a low NOX, high efficiency fuel burner, the basket comprising: a base defining a longitudinal basket axis and including a burner throat of a sufficient size to permit the introduction of the fuel and an off-stoichiometric amount of primary combustion air, a tubular wall extending generally transversely away from the base in surrounding relation to the throat, a free-end of the wall defining an outlet for the basket, a plurality of heat radiating cutouts in the wall at least a portion of which extends upstream from the basket outlet to permit heat from a flame in the basket to radiate substantially perpendicular to a longitudinal axis of the basket to heat transfer surfaces surrounding the basket when installed in a furnace, and a multiplicity of secondary combustion air conduits terminating proximate the basket outlet for discharging streams of secondary combustion air into a section of the flame formed by the fuel and disposed downstream of the basket outlet, wherein the conduits are oriented so that secondary air streams issuing therefrom are tangential to an imaginary cylinder which is concentric to the longitudinal axis so that the secondary airstreams impart a rotary motion to the section of the flame.

2. A basket according to claim 1 wherein the conduits converge in a downstream direction so that the secondary combustion air streams enter the flame and propagate towards a center of the flame.

3. A basket according to claim 2, wherein the conduits are angularly inclined relative to the longitudinal axis at an angle which lies in the range of between about 7° and 15°.

4. A basket according to claim 1 wherein the imaginary cylinder is selected so that the rotary motion imparted to the section of the flamegenerates a physical force which tends to expand the periphery of the flame section and which is selected to offset the tendency of the converging secondary airstream to contract the periphery of the flame section, whereby the actual periphery of the flame section remains substantially cylindrical.

5. A basket according to claim 4 wherein the conduits lie in planes which are inclined to the axis of the basket by an angle between about 15° to 20°.

6. A basket according to claim 4 wherein at least some of the conduits are positioned so that the secondary airstreams issuing therefrom enter the flame section at axially spaced locations to prevent the formation of a secondary air sheath.

7. A basket according to claim 6 wherein a majority of conduits have discharge ends which are axially spaced from the discharge ends of the adjoining conduits.

8. A basket according to claim 1 wherein the conduits are disposed within the basket wall and have discharge ends at the end of the basket wall.

9. A basket according to claim 8 wherein the basket wall and the conduits converge in a downstream direction towards the longitudinal axis at an angle with respect to the axis in the range of between about 7° to 15°.

10. A basket according to claim 9 wherein the cutouts are defined by undulations in the free-end of the basket wall, and wherein the secondary air conduits have discharge ends which coincide with the basket wall end defined by the undulations so that secondary airstreams from the conduits enter the section of the flame downstream of the basket at axially spaced locations to prevent the formation within the flame section of a secondary air sheath.

11. A basket according to claim 10 wherein the secondary air conduits are oriented so that the secondary airstreams issuing therefrom impart a rotary motion to the flame section which counteracts and substantially balances the contraction of the flame section periphery caused by the convergence of the secondary airstreams, whereby the periphery of the flame section remains substantially cylindrical.

12. A basket according to claim 8 wherein the discharge ends of the conduits are spaced from each other by no more than about 1 to 2 inches.

13. A basket according to claim 8 wherein at least portions of the conduits are formed by the basket wall.

14. A basket according to claims 8 or 13, wherein at least a portion of the conduits is defined by tubes disposed within the wall.

15. A basket according to claim 1 wherein the throat includes a flared section which opens in a downstream direction.

16. A basket according to claim 15 wherein the flared section has a radius of at least about 12 inches.

17. A basket according to claim 1 having a length from the base to the outlet in the range of between about 24 to 96 inches.

18. A basket according to claim 1 including a multiplicity of first orifices for discharging a portion of the secondary combustion air into a space defined by the basket, the first orifices being arranged so that secondary airstreams discharged therefrom are tangential to an imaginary cylinder which is concentric to the longitudinal axis at points which are axially spaced from the points of tangency of the other secondary airstreams from the first orifices.

19. A basket according to claim 18 wherein the secondary airstreams discharged from the first orifices have a substantially like angularity with respect to the longitudinal axis, and wherein the first orifices are spaced apart in an axial direction so that the respective secondary airstreams are tangent to the imaginary cylinder at axially spaced points.

20. A basket according to claim 18 wherein the first orifices are located in substantially a single plane which is perpendicular to the longitudinal axis, and wherein the first orifices are arranged so as to discharge the secondary airstreams therefrom at differing angles selected so that the secondary airstreams are tangent to the imaginary cylinder at points which are spaced apart in an axial direction.

21. A basket according to claim 18 wherein the secondary conduits are at least in part defined by tubes disposed within the basket wall and extending from about the base to the outlet end of the wall, and wherein each first orifice is defined by a pair of passageways communicating through corresponding openings with the space defined by the basket, each passageway of a pair of passageways being disposed so that a secondary air tube is disposed between them.

22. A basket according to claim 18 including a set of a plurality of second orifices disposed upstream of the first orifices for discharging additional secondary combustion air into the space, the second orifices being arranged to direct streams of secondary air into the vicinity of the space which is proximate the longitudinal axis.

23. A basket according to claim 22 wherein the number of second orifices is smaller than the number of first orifices.

24. A basket according to claim 23 wherein the second orifices have larger cross-sections than the first orifices to enable secondary airstreams discharged by the second orifices to reach the vicinity of the axis.

25. A basket according to claim 1 wherein the outlet of the basket has a substantially circular configuration.

26. A basket according to claim 1 wherein a portion of the wall proximate the base has a substantially circular configuration, and wherein the outlet of wall has a non-circular configuration.

27. A basket according to claim 1 including means for demountably securing the basket to a furnace wall.

28. A basket according to claim 1 including a wind box connected with the basket, in fluid communication with the throat and adapted to be connected to a source of primary combustion air for flowing primary combustion air from the source through the wind box and the throat into the space.

29. A basket according to claim 28 including means for imparting to the primary combustion air flowing from the wind box through the throat into the space a rotary motion sufficient to expand a flame within the space so that it is at all times in contact with the basket wall.

30. A basket according to claim 29 wherein a section of the throat contiguous with the combustion space is flared open in a downstream direction and has a convex configuration to facilitate contact between the rotating flame in the space and the basket wall.

31. A basket according to claim 18 including a secondary air plenum attached to the baskets, in fluid communication with the secondary air conduits and adapted to be connected with a source of secondary combustion air.

32. A low NOX, high efficiency industrial burner adapted to burn fuel, including fuel having a relatively high nitrogen content, with relatively low excess air and without generating significant amounts of NOX, the burner comprising in combination:

a burner basket defined by a base, a tubular burner wall projecting from the base in a downstream direction and terminating in an outlet end, the base and the wall defining a primary combustion space, the wall having a length of at least about 24 inches, the wall having undulations at the outlet end extending periodically from the end in an upstream direction to define cut-outs through which heat from a flame in the space can radiate substantially perpendicular to the longitudinal axis of the flame to heat exchange surfaces surrounding the basket, the base further having a throat concentric with the axis;

means for demountably attaching the basket to a furnace wall;

means for introducing fuel via the throat into the space;

a primary combustion air register attached to the base, in fluid communication with the throat and adapted to be connected to a source of primary combustion air for flowing primary combustion air via the throat into the space and mixing it with the fuel for forming a flame in the space;

a multiplicity of substantially evenly spaced, secondary combustion air conduits disposed in the wall and terminating at the outlet end of the wall at axially offset points as determined by the wall undulations, the conduits being arranged to discharge their respective secondary airstreams into a section of the flame downstream of the basket towards a center portion of the flame in a manner to maintain a periphery of the flame section substantially cylindrical over substantially the full length of the flame section;

and means controlling the flow ratio of primary combustion air to secondary combustion air so that the flame in the space is sufficiently oxygen deficient to prevent the formation of NOX in the space.

33. A burner according to claim 32 wherein the cutouts are dimensioned to effect a sufficient heat loss through radiation from the flame in the space so that the temperature of the flame section does not substantially exceed 3,000° F. to thereby prevent the formation of NOX in the flame section.

34. A burner according to claim 33 including a plurality of secondary air discharge orifices in the wall for flowing secondary combustion air in an amount not substantially in excess of 10% of stoichiometric air into the space, the orifices being arranged to evenly distribute secondary air discharged therefrom into the flame in the space to thereby prevent the formation of excess air pockets in the flame and thus prevent the generation of NOX in the space.

35. A burner according to claim 32 wherein the wall is constructed of a refractory material, wherein the conduits are disposed within the wall, wherein the wall converges in a downstream direction towards the axis, and wherein the conduits in the wall are substantially straight and lie in planes which are angularly inclined with respect to the axis so that the secondary air streams impart rotation to the flame section which is selected to maintain the flame periphery substantially cylindrical.

36. A burner basket for use with a low NOX, high efficiency fuel burner, the basket comprising: a base defining a longitudinal basket axis and including a burner throat of a sufficient size to permit the introduction of the fuel and an off-stoichiometric amount of primary combustion air, a tubular wall extending generally transversely away from the base in surrounding relation to the throat, a free-end of the wall defining an outlet for the basket, a plurality of heat radiating cutouts defined by undulations in the free-end of the basket wall at least a portion of which extends upstream from the basket outlet to permit heat from a flame in the basket to radiate substantially perpendicular to a longitudinal axis of the basket to heat transfer surfaces surrounding the basket when installed in a furnace, and a multiplicity of secondary combustion air conduits disposed within the basket wall having discharge ends which coincide with the basket wall end defined by the undulations so that secondary airstreams from the conduits enter the section of the flame downstream of the basket at axially spaced locations to prevent the formation within the flame section of a secondary air sheath.

37. A burner basket for use with a low NOX, high efficiency fuel burner, the basket comprising: a base defining a longitudinal basket axis and including a burner throat of a sufficient size to permit the introduction of the fuel and an off-stoichiometric amount of primary combustion air, a tubular wall extending generally transversely away from the base in surrounding relation to the throat, a free-end of the wall defining an outlet for the basket, a plurality of heat radiating cutouts in the wall at least a portion of which extends upstream from the basket outlet to permit heat from a flame in the basket to radiate substantially perpendicular to a longitudinal axis of the basket to heat transfer surfaces surrounding the basket when installed in a furnace, a multiplicity of secondary combustion air conduits terminating proximate the basket outlet for discharging streams of secondary combustion air into a section of the flame formed by the fuel and disposed downstream of the basket outlet, and a multiplicitiy of first orifices for discharging a portion of the secondary combustion air into a space defined by the basket, the first orifices being arranged so that secondary airstreams discharged therefrom are tangential to an imaginary cylinder which is concentric to the longitudinal axis a points which are axially spaced from the points of tangency of the other secondary airstreams from the first orifices.

38. A basket according to claim 36 wherein, in cross-section, the outlet of the basket has an oval configuration.

39. A basket according to claim 36 wherein the outlet of the basket, in cross-section, has a generally rectangular configuration.

* * * * *